US005186764A

United States Patent [19]

Stiasny

[11] Patent Number: 5,186,764

[45] Date of Patent: Feb. 16, 1993

[54] METHOD AND APPARATUS FOR TREATING PLATES WITH GAS

[75] Inventor: Carl-Heinz Stiasny, Gais, Italy

[73] Assignee: Viscodrive GmbH, Lohmar, Fed. Rep. of Germany

[21] Appl. No.: 746,793

[22] Filed: Aug. 12, 1991

Related U.S. Application Data

[63] Continuation of Ser. No. 479,345, Feb. 13, 1990, abandoned.

[51] Int. Cl.[5] ..... G21D 1/48

[52] U.S. Cl. ..... 148/206; 148/604; 266/252

[58] Field of Search ..... 266/249, 252; 432/253; 148/604, 206, 207

[56] References Cited

U.S. PATENT DOCUMENTS

| | | | |
|---|---|---|---|
| 2,067,896 | 1/1937 | Babinet | 148/16.6 |
| 3,201,290 | 9/1963 | Wyss | 148/16.5 |
| 4,051,382 | 9/1977 | Ogawa et al. | 118/725 |
| 4,593,644 | 6/1986 | Hanak | 118/723 |

FOREIGN PATENT DOCUMENTS

| | | | |
|---|---|---|---|
| 60-165370 | 8/1985 | Japan | 148/16.6 |

*Primary Examiner*—Scott Kastler
*Attorney, Agent, or Firm*—Anderson Kill Olick & Oshinsky

[57] ABSTRACT

A method of treating apertured plates with a gaseous medium, e.g. to produce a nitride surface layer thereon, by placing the plates in rows in a furnace and causing the gaseous medium to flow across the surfaces of the plates by circulating the medium through the furnace and deflecting the medium as it flows along the furnace walls away from the walls to give a substantially uniform flow of gas across the plate surfaces.

17 Claims, 6 Drawing Sheets

21
22
23
24
25
26
27
28
28a
29
30
31
32
33
35
37
38
39
40
41
42
43
44
45
46
47
51
52
20

METHOD AND APPARATUS FOR TREATING PLATES WITH GAS

This is a continuation application of Ser. No. 07/479,345, filed Feb. 13, 1990 now abandoned.

BACKGROUND TO THE INVENTION

1. Field of the Invention

This invention relates to the treatment of apertured plates with a gas. More specifically the invention has been developed for the treatment of apertured thin steel plates with a nitriding or nitrocarburising gaseous medium to form a layer of iron nitride on the surfaces of the plates. The invention provides apparatus for such treatment, a method of treatment and a fixture on which a multiplicity of plates can be supported for treatment.

2. Description of the Prior Art

It is known from U.S. Pat. No. 4,793,871 assigned to Lucas Industries plc and issued Dec. 27th 1988 to treat steel plates to provide an iron nitride layer thereon by heating the plates in an inert atmosphere in a retort and then evacuating the inert atmosphere and introducing a nitrogen-containing gas which reacts with the heated plates to form the iron nitride layer on the surface thereof.

In prior apparatus used for this purpose, the number of plates that could be accommodated in the retort so as to be properly treated was limited since one relied solely on the undirected circulation of the nitrogen-containing gas through the furnace by a fan.

SUMMARY OF THE INVENTION

It is an object of one aspect of the present invention to provide apparatus which will allow the effective treatment of a much greater number of plates than heretofore in the process described above. It is an object of another aspect of the invention to a provide an effective treatment method and it is an object of a third aspect of the invention to provide a fixture for the plates which will conveniently accommodate them for effective treatment by a gaseous medium.

According to one aspect of the present invention we provide apparatus for treating a multiplicity of apertured plates with a gaseous medium comprising a chamber defined by opposite end walls and bottom, top and side walls extending between said end walls; means to circulate gaseous medium through said chamber in a general direction from one of said end walls to the other end wall, means to support said plates in the chamber in mutually spaced relation in a plurality of adjacent rows which extend generally parallel to said end walls so that faces of the plates lie parallel to said general direction of flow; and deflector means on at least some of said bottom, top and side walls for deflecting gas flowing along said walls to flow towards and between said rows so that the gas flow across all said plates is substantially uniform.

The provision of the deflector means enables a large number of plates to be contained in the apparatus for treatment in an effective manner due to the uniformity of the gas flow across the plates.

Preferably said deflector means comprise a plurality of deflecting members mounted on at least some of said bottom, top and side walls to project therefrom and so that the projection of the deflecting members from the wall on which they are mounted increases the nearer said deflecting members are to said other end wall of the chamber. The deflection of the gas is thus progressively increased as it flows through the chamber and this ensures the uniformity of the gas flow across the plates.

More specifically the invention provides apparatus for treating a multiplicity of apertured plates with a gaseous medium comprising a chamber defined by opposite end walls and bottom, top and side walls extending between said end walls; means to circulate gaseous medium through said chamber in a general direction from one of said end walls to the other end wall; a fixture for supporting said plates in said chamber and comprising a base having opposed sides, a plurality of vertical columns mounted on each of said sides, each column of the plurality on one of said sides being aligned with a column of the plurality on the other of said sides to form a pair, a plurality of support bars each extending between a pair of columns so that the support bars are generally parallel to said end walls and so that a number of support bars engage each such pair of columns, each bar being adapted to be threaded through the apertures in a plurality of said plates to support the latter in rows and having locating means to hold the plates threaded thereon in fixed positions and in mutually spaced relation, an apertured end fitting at the end of each support bar, each such fitting having an aperture through which a column passes, and spacers on each column between the end fittings of adjacent support bars on the column to hold said support bars in vertically spaced relation on the column; and deflector means on at least some of said bottom, top and side walls for deflecting gas flowing along along said walls to flow towards and between rows of plates mounted on the support bars so that the gas flow across all said plates is substantially uniform.

The provision of a fixture as set forth above together with the deflector means enables a large number of plates to be effectively treated with the gaseous medium One of said end walls may form a door and said chamber may include means whereby said fixture can be moved into and out of said chamber through the door. Said means for moving the fixture into and out of the chamber preferably includes a roller conveyor mounted on the bottom wall of the chamber.

The invention also provides a method of treating plates with a gaseous medium in a chamber defined by opposite end walls and side walls extending between said end walls and in which the gaseous medium is circulated in a general direction from one of said end walls to the other, comprising mounting said plates in said chamber in fixed positions and in mutually spaced relation in a plurality of adjacent rows extending generally parallel to said end walls so that faces of the plates lie parallel to the general direction of flow of gaseous medium through the chamber and deflecting gaseous medium which flows along said walls so that said deflected gaseous medium flows towards and between said rows and so that the flow of gaseous medium across all of said plates is substantially uniform.

The mounting of the plates so that their faces lie parallel to the general direction of gas flow through the chamber, together with the deflection of the gaseous medium ensure effective treatment of the plates.

The plates are preferably apertured and are mounted in said rows with their apertures aligned, so that said deflected gaseous medium also flows into the aligned apertures of the rows of plates. The plates may be mounted in mutually spaced relation in notches on support bars which pass through the aligned apertures of each row of plates.

Preferably the plates are of steel and are heated in the chamber in an inert atmosphere which is then evacuated and replaced by a gaseous medium which is a nitriding or nitrocarburising medium and is heated and circulated to form a surface layer of iron nitride on said plates.

The invention also provides a fixture for supporting a multiplicity of apertured plates whilst undergoing treatment with a gaseous medium, the fixture comprising a base having opposed sides, a plurality of vertical columns mounted on each of said sides, each column of the plurality on one of said sides being aligned with a column of the plurality on the other of said sides to form a pair, a plurality of support bars each extending between a pair of columns so that a number of support bars engage each such pair of columns, each bar being adapted to be threaded through the apertures in a plurality of said plates to support the latter and having locating means to hold the plates threaded thereon in fixed positions and in mutually spaced relation, an apertured end fitting at the end of each support bar, each such fitting having an aperture through which a column passes, and spacers on each column between the end fittings of adjacent support bars on the column to hold said support bars in vertically spaced relation on the column.

The locating means on the support bars may be notches, preferably of Vee-shape, to receive the edges of the apertures in the plates. The support bars may be of upwardly open Vee-section with said notches provided in opposed sides of the Vee.

At least one tie bar may connect together the columns of each plurality adjacent the tops of the columns and may have apertures to receive the columns whilst being of angle section between said apertures.

Each of said columns may consist of a plurality of separate parts which mutually and telescopically interfit. This enables the fixture to be built up as the plates are being mounted on it.

BRIEF DESCRIPTION OF THE DRAWINGS

The invention will now be described in detail by way of example with reference to the accompanying drawings, in which.

DESCRIPTION OF PREFERRED EMBODIMENTS

Figure 1:
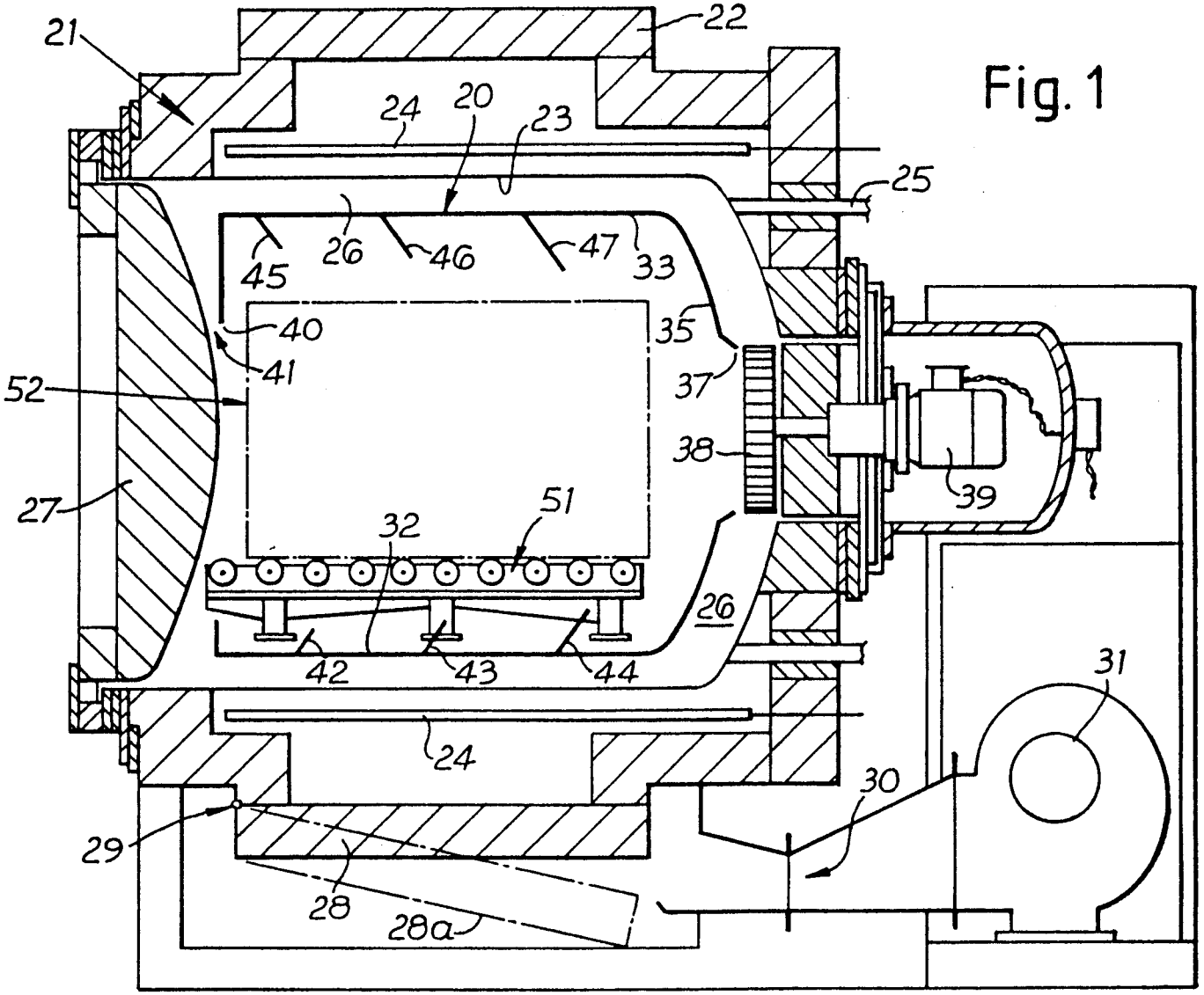
FIG. 1 is a vertical cross-section through a furnace embodying the invention.
Figure 2:
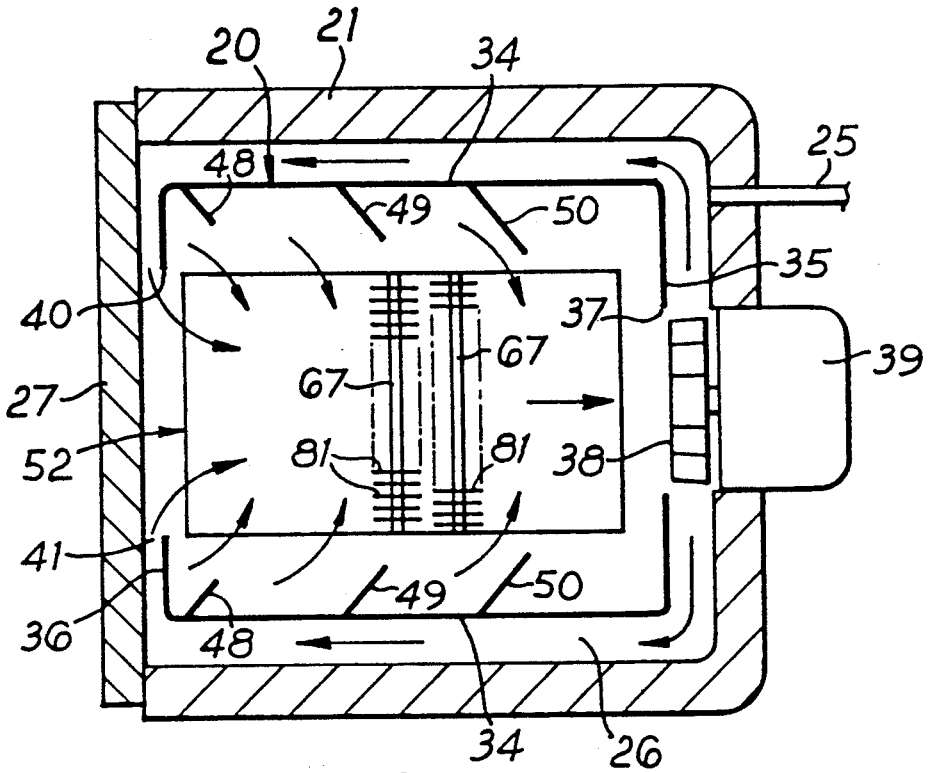
FIGS. 2 and 3 are diagrammatic plan and vertical-sectional views respectively through the furnace of FIG. 1 illustrating the gas flow through the furnace.
Figure 3:
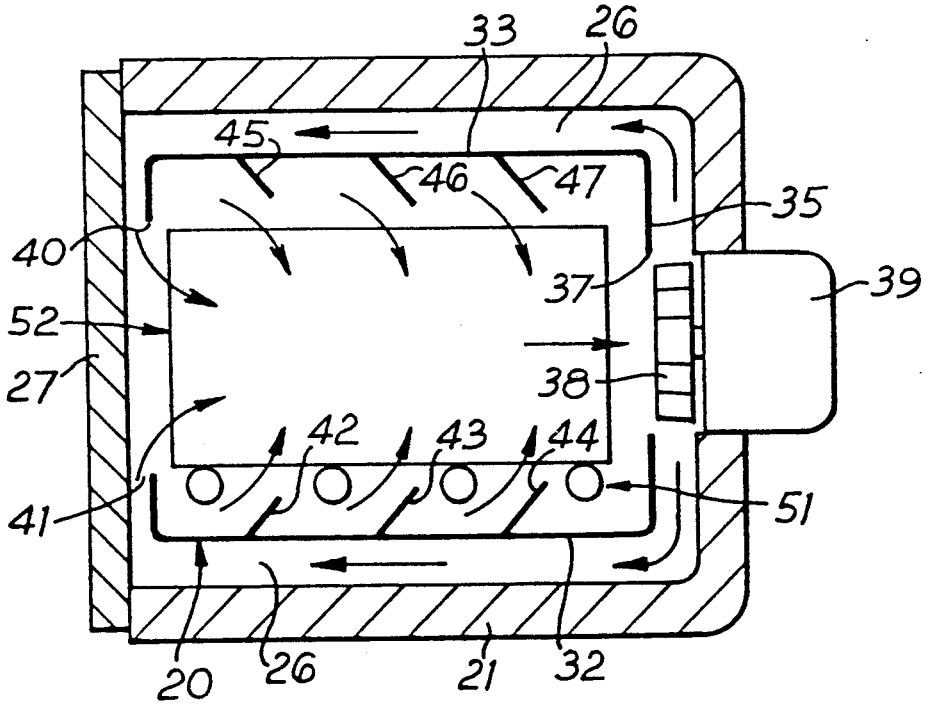

Referring first to FIGS. 1 to 3 these show a furnace suitable for nitriding the surfaces of thin apertured steel plates. The furnace comprises a central chamber 20 mounted within a furnace structure indicated generally at 21. The furnace has an outer housing 22 of refractory and heat-insulating material and a lining 23. Between the housing 21 and the lining 23 are heating elements, two of which are shown at 24. A pipe 25 is connected to the lining 23 and passes through the housing 22 and allows the introduction of gaseous treating medium into the interior of the lining. There is a space 26 between the lining 23 and the exterior of the chamber 20.

The furnace structure carries a door 27 which fits into the left-hand end of the lining 23 to close the furnace. The door may be opened by moving it to the left in FIG. 1 and then lifting it by means not shown.

A lower wall 28 of the furnace structure is pivoted at 29 so that it may move to the dotted line position shown at **28*a* which then places a duct 30 in communication with the interior of the lining 23. The duct 30 is connected to an evacuation fan 31** which enables gas to be drawn out of the furnace.

The chamber 20 is defined by bottom and top walls 32 and 33, side walls 34 and end walls 35 and 36. The end wall 35 has a central aperture 37 in which is mounted a circulating fan 38 which is arranged to draw gas from the chamber 20 and discharge it into the space 26 between the chamber 20 and the lining 23. The fan is driven by an electric motor 39.

The end wall 36 of the chamber has an aperture 40 which is partially closed by the furnace door 27 which thus forms part of the left-hand end wall of the chamber. The clearance 41 between the aperture and the door 27 communicates with the space 26 and the interior of the chamber.

Each of the walls 32 to 34 is provided with three baffles. Thus the bottom wall 32 is provided with baffles 42, 43 and 44. The baffles are inclined to the right in the drawings towards the wall 35 and it will be seen that the baffles extend further from the wall 32 the nearer they are to the wall 35. Thus the baffle 44 extends further from the wall 32 than does the baffle 43 and the latter extends further from the wall 32 than does the baffle 42.

The top wall 33 has three baffles 45, 46 and 47 and each of the side walls 34 has three baffles 48, 49 and 50. As will be seen from the drawings all the baffles are inclined to the right towards the wall 35 and they are all arranged as described with reference to the baffles 42 to 44 i.e. the baffles nearer the wall 35 extend further from the wall to which they are attached than do the baffles further from the wall 35.

The bottom wall 32 of the chamber supports a roller conveyor 51 on which is received a fixture 52, described below, on which plates are mounted for treatment in the chamber. The fixture can be moved into and out of the chamber 20 when the door 27 is open.

Figure 4:
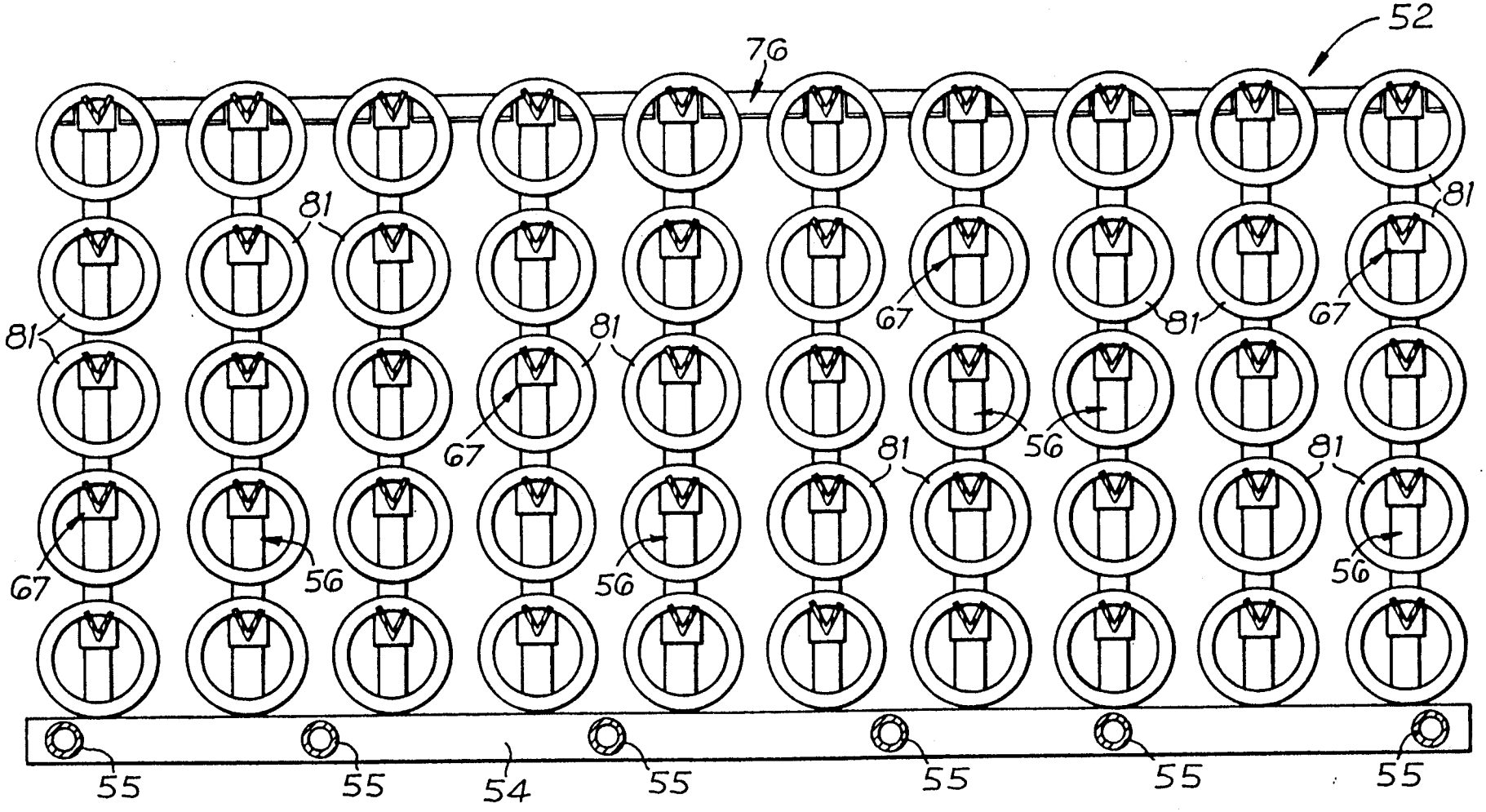
FIG. 4 is a vertical section through a fixture embodying the invention shown holding a multiplicity of plates for treatment.
Figure 5:
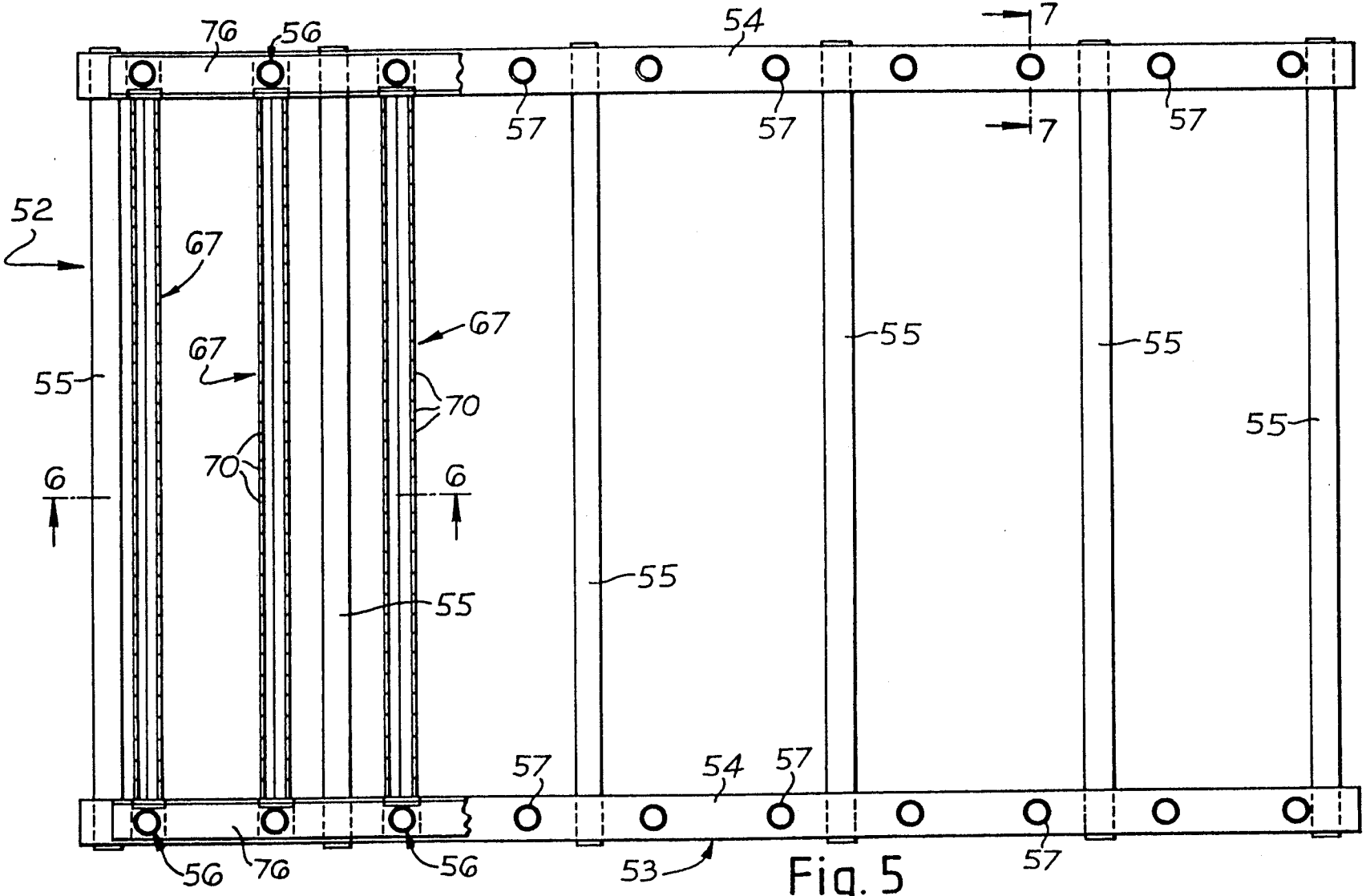
FIG. 5 is a plan view, partially broken away, of the fixture shown in FIG. 4.
Figure 6:
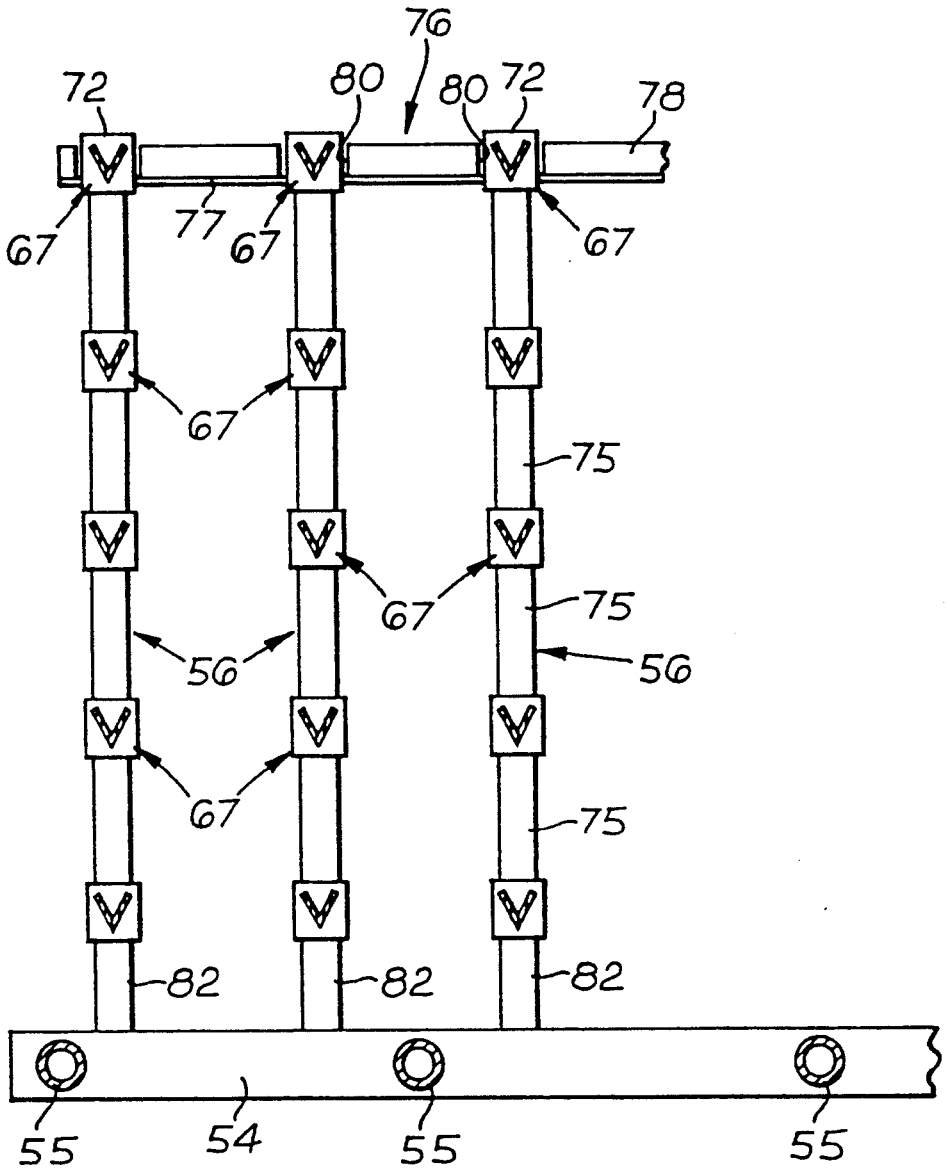
FIG. 6 is a part section of the fixture on the line 6—6 of FIG. 5.
Figure 7:
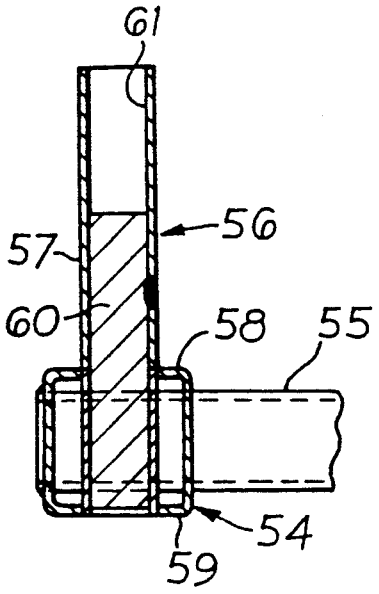
FIG. 7 is a section on the line 7—7 of FIG. 5.

Referring now to FIGS. 4 to 11 the fixture 52 comprises a base 53, FIGS. 5 and 6, comprising opposed sides 54 in the form of square tubes which are held in spaced apart relation by six cross-pieces 55. Each side 54 of the base supports ten vertical columns 56, each column on one side of the base being aligned with a column on the other side of the base. Referring to FIG. 7 the base of each column 56 comprises a cylindrical tube 57 welded in aligned apertures in the upper and lower walls 58 and 59 of a side 54 to project upwardly from the side. A cylindrical re-enforcing bar 60 is received in the lower part of the tube while the upper part thereof forms a socket 61.

Figure 8:
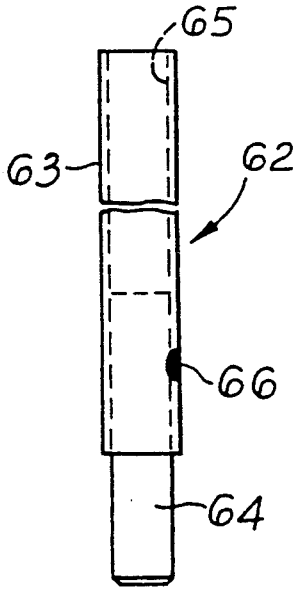
FIG. 8 is an elevation of a component of one of the columns of the fixture of FIG. 4.
Figure 9:
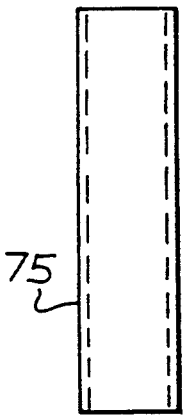
FIG. 9 is an elevation of a tubular spacer for the fixture columns.

Each column 56 is built up on a tube 57 with a number of components such as 62 and spacers shown in FIGS. 8 and 9 respectively. Each component 62 comprises a cylindrical tube 63 of the same diameter as the tube 57 and a cylindrical spigot 64 dimensioned to fit into the socket 61 in the tube 57 and a similar socket 65 in the tube 63 of another component 62. The tube 63 and spigot 64 are welded together at 66.

Thus a column 56 is built on a tube 57 by inserting the spigot 64 of a component 62 into the socket 61 and then inserting the spigot 64 of another component 62 into the socket 65 of the component already in place on the column and so on.

Figure 10:
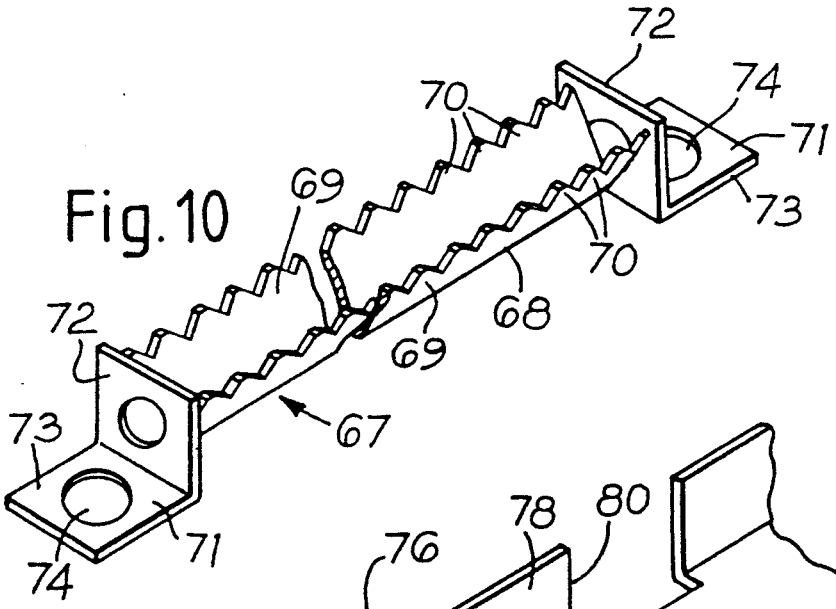
FIG. 10 is a perspective partial view of a support bar forming part of the fixture of FIG. 4.

FIG. 10 shows a support bar 67 which fits between two aligned columns of the fixture, one on each side 54 of the base 53. The support bar has a central section 68 of Vee-section with opposed sides 69. Formed in each of the opposed sides 69 is a series of Vee-shaped notches 70, the notches in one side 69 being aligned with the notches in the other side 69. At each end the support bar has an apertured end fitting 71 of angle section with its flanges vertical and horizontal. The vertical flanges 72 are welded to the ends of the central section 68 and the horizontal flanges 73 are provided with apertures 74. The apertures 74 are of such size as to fit over the tubes 57 and 63 with a small clearance. As will be described below, the apertures 74 of the support bars are threaded over the tubes 57 and 63 and are held in vertical spaced relation by tubular spacers 75 shown in FIG. 9 which slide over the tubes 57 and 63.

Figure 11:
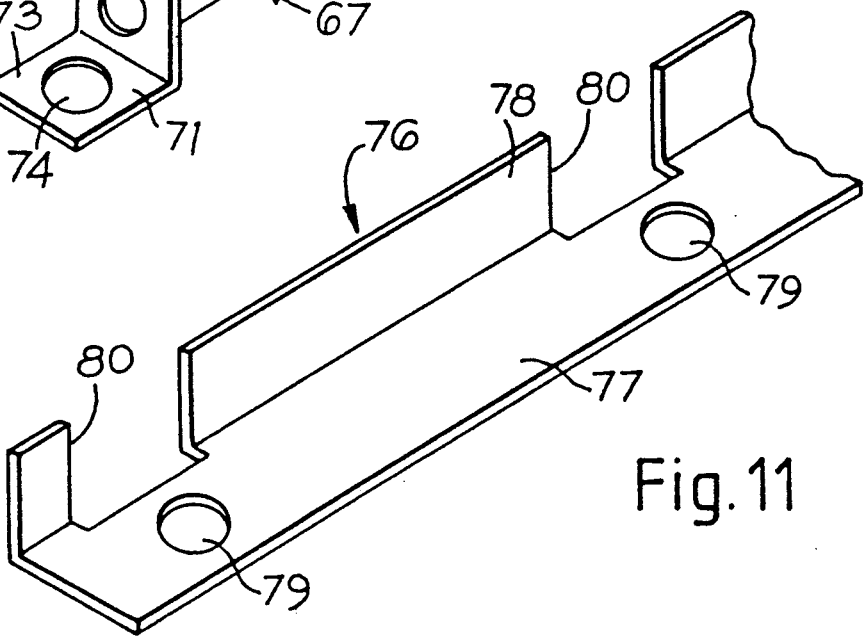
FIG. 11 is a perspective partial view of a tie bar forming part of the fixture of FIG. 4.

FIG. 11 shows a tie bar 76 for the fixture. The tie bar is of angle section having horizontal and vertical flanges 77 and 78. The flange 77 is apertured at 79 to receive the tubes 63 of the components 62 and so that it may be supported by spacers 75. The apertures 79 are spaced to receive the upper ends of the columns 56. The vertical flange is cut away at 80 to give clearance to the vertical flanges 72 of the support bars 67 as shown in FIG. 6.

FIG. 4 is a section through the whole fixture assembled and carrying a multiplicity of apertured plates 81, the edges of the apertures being received in the notches 70 of the support bars 67. Each plate is received in one aligned pair of notches in a support bar and this holds the plates in fixed positions in spaced-apart relation.

The fixture 52 is built up and filled with plates as follows. Starting with the base 53 with the attached tubes 57, one aligned pair of columns is built up at a time. Thus the spigots 64 of components 62 are inserted in the sockets 61 of the tubes 57 and short spacers 82, similar to the spacers 75 but shorter, are put on the tubes 57. A support bar 67 is then filled with plates 81 and the apertures 74 on the ends thereof threaded over the tubes 63 to rest on the tops of the spacers 82. Spacers 75 are then threaded over the tubes 63 of the lowermost components 62. Then another pair of components 62 has its spigots inserted in the sockets 65 of the lowermost pair of components 62. Then another support bar with its plates 81 is threaded over the tubes 63 of the uppermost components 62 and the sequence is continued until there are five support bars on each column as shown in FIGS. 4 and 6. The remaining columns on the base are built up in the same way. When all the columns have been built up a tie bar 76 is slipped over the upper ends of the columns on each side of the fixture to give a rigid assembly.

The fixture 52 with its plates is then placed in the chamber 20 so that the support bars 67 extend parallel to the end walls 35 and 36 of the chamber as shown diagramatically in FIG. 2 so that the faces of the plates are parallel to the side walls 34 of the chamber and, as will be described, parallel to the general direction of gas flow through the chamber.

Preferably the plates 81 are made of non-alloyed steel or fine grained structural steel containing niobium and vanadium or titanium and range from 0.4 to about 5 mm in thickness.

When the fixture 52 with its plates has been inserted in the chamber 20, the door 27 is shut. The lower wall 28 of the furnace is pivoted down and air is evacuated from the interior of the furnace by the pump 31. An inert atmosphere e.g. nitrogen is introduced into the furnace through the pipe 25 and the lower wall 28 closed. The furnace is then heated by the heaters 24 to a temperature between 600 and 700 degrees C.

The inert gas is then evacuated by the pump 30 and a gaseous medium capable of nitriding the surfaces of the plates is introduced as described in said above mentioned U.S. Pat. No. 4,793,871.

During the heating of the furnace the inert atmosphere is circulated by the fan 38. Thus the inert gas is drawn by the fan 38 from the interior of the chamber and discharged to the space 26 from which it again enters the left-hand end of the chamber. The baffles 42 to 50 respectively direct the flowing gas inwardly towards the centre of the chamber and thus into the spaces between the rows of plates 81 on the support bars 67. This gives a substantially uniform flow of gas over all the plates and thus even heating of the plates. The gas flow is shown by the arrows in FIGS. 2 and 3.

When the nitrogen-containing gas is introduced into the chamber to treat the plates, this also is circulated by the fan 38 and deflected by the baffles to give a substantially uniform flow of reactive gas over the surfaces of the plates and thus ensure a uniform coating of nitride on the plates.

The provision of the baffles in the furnace ensures an even flow of gas over the surfaces of the plates both to heat and to treat them and the support of the plates in the fixture as described enables a large number of plates to be treated at one time and exposed to a uniform gas flow due to the baffles.

I claim:

1. Apparatus for treating a multiplicity of apertured plates with a gaseous medium comprising a furnace, a chamber defined by opposite end walls and side walls extending between said end walls, apertures in said end walls; the chamber being located within said furnace so that a space is provided between the chamber and the furnace; means to circulate gaseous medium through said chamber in a general direction from said aperture in one of said end walls to said aperture in the other end wall and through said space from said aperture in said other end wall to said aperture in said one end wall; means to support said plates in the chamber in fixed positions and in mutually spaced relation in a plurality of adjacent rows which extend generally parallel to said end walls so that faces of the plates lie parallel to said general direction of flow; and deflector means on the side walls deflecting gaseous medium flowing within the chamber along the side walls to flow away from said side walls towards and between said rows to give a substantially uniform flow of gaseous medium across the whole of the cross-sectional area of the chamber transverse to said general direction of flow and thus to give a substantially uniform flow of gaseous medium across all of said plates.

2. Apparatus according to claim 1, wherein said deflector means comprise a plurality of deflecting members mounted on the side walls to project therefrom and wherein the projection of the deflecting members from the wall on which they are mounted increases the nearer said deflecting members are to said other end wall of the chamber.

3. Apparatus for treating a multiplicity of apertured plates with a gaseous medium comprising a furnace, a chamber defined by opposite end walls and side walls extending between said end walls, apertures in said end walls; the chamber being located within said furnace so that a space is provided between the chamber and the furnace; means to circulate gaseous medium through said chamber in a general direction from said aperture in one of said end walls to said aperture in the other end wall and through said space from said aperture in said other end wall to said aperture in said one end wall; a fixture for supporting said plates in said chamber and comprising a base having opposed sides, a plurality of vertical columns mounted on each of said sides, each column of the plurality on one of said sides being aligned with a column of the plurality on the other of said sides to form a pair, a plurality of support bars each extending between a pair of columns so that the support bars are generally parallel to said end walls and so that a number of support bars engage each such pair of columns, each bar being adapted to be threaded through the apertures in a plurality of said plates to support the latter in rows and having locating means to hold the plates threaded thereon in fixed positions and in mutually spaced relation, an apertured end fitting at the end of each support bar, each such fitting having an aperture through which a column passes, and spacers on each column between the end fittings of adjacent support bars on the column to hold said support bars in vertical spaced relation on the column; and deflector means on said side walls for deflecting gaseous medium flowing along said side walls within the chamber to flow away from said side walls towards and between the rows of plates mounted on the support bars to give a substantially uniform flow of gaseous medium across the whole of the cross-sectional area of the chamber transverse to said general direction of flow and thus to give a substantially uniform flow of gaseous medium across all of the plates.

4. Apparatus according to claim 3, wherein one of said end walls is in the form of a door and wherein said chamber includes means whereby said fixture can be moved into and out of said chamber through the door.

5. Apparatus according to claim 4, wherein said means for moving the fixture into and out of the chamber includes a roller conveyor mounted on the bottom wall of the chamber.

6. A method of treating plates with a gaseous medium in a chamber located within a furnace so that a space is provided between the chamber and the furnace, the chamber being defined by opposite end walls and side walls extending between said end walls, each of said end walls having an aperture therein, and in which the gaseous medium is circulated through the chamber in a general direction from the aperture in one of said end walls to the aperture in the other of said end walls and through said space from said aperture in said other end wall to said aperture in said one end wall, the method comprising mounting said plates in said chamber in fixed positions and in mutually spaced relation in a plurality of adjacent rows extending parallel to said end walls so that faces of the plates lie parallel to the general direction of flow of gaseous medium through the chamber and causing gaseous medium which flows within the chamber along said side walls to flow away from said side walls so that said deflected gaseous medium flows towards and between said rows to give a substantially uniform flow of gaseous medium across the whole of the cross-sectional area of the chamber transverse to said general direction of flow and thus to give a substantially uniform flow of gaseous medium across all of said plates.

7. A method according to claim 6, wherein the plates are apertured and are mounted in said rows with their apertures aligned, and wherein said deflected gaseous medium also flows into the aligned apertures of the rows of plates.

8. A method according to claim 7, wherein the plates are mounted in mutually spaced relation in notches on support bars which pass through the aligned apertures of each row of plates.

9. A method according to claim 6, wherein the plates are of steel and are heated in the chamber in an inert atmosphere which is then evacuated and replaced by said gaseous medium which is a nitriding or nitrocarburising medium and is heated and circulated to form a surface layer of iron nitride on said plates.

10. A method according to claim 9 wherein the plates are formed of a non-alloyed steel or fine grained structural steel containing niobium and vanadium or titanium.

11. A fixture for supporting a multiplicity of apertured plates while undergoing treatment with a gaseous medium, the fixture comprising a base having opposed sides, a plurality of vertical columns mounted on each of said sides, each column of the plurality on one of said sides being aligned with a column of the plurality on the other of said sides to form a pair, a plurality of support bars each extending between a pair of columns, each bar being adapted to be threaded through the apertures in a plurality of said plates to support the latter and having locating means to hold the plates threaded thereon in fixed positions and in mutually spaced relation, an apertured end fitting at the end of each support bar, each such fitting having an aperture through which a column passes, and spacers on each column between the end fittings of adjacent support bars on the column to hold said support bars in vertical spaced relation on the column.

12. A fixture according to claim 11, wherein the locating means on the support bars are notches to receive the edges of the aperture in the plates.

13. A fixture according to claim 12, wherein the notches are Vee-shaped.

14. A fixture according to claim 12, wherein the support bars are of upwardly open Vee-section having opposed sides and said notches are provided in said opposed sides.

15. A fixture according to claim 11, wherein at least one tie bar connects together the columns of each plurality adjacent the tops of the columns.

16. A fixture according to claim 15, wherein each tie bar has apertures to receive the columns and is of angle section between said apertures.

17. A fixture according to claim 11, wherein each of said columns consists of a plurality of separate parts which mutually and telescopically interfit.

* * * * *